US009074433B2

(12) United States Patent
Hall et al.

(10) Patent No.: US 9,074,433 B2
(45) Date of Patent: Jul. 7, 2015

(54) FIXED BLADED DRILL BIT CUTTER PROFILE

(71) Applicants: David R. Hall, Provo, UT (US); Casey Webb, Spanish Fork, UT (US); Davido L. Hyer, Springville, UT (US)

(72) Inventors: David R. Hall, Provo, UT (US); Casey Webb, Spanish Fork, UT (US); Davido L. Hyer, Springville, UT (US)

(73) Assignee: Schlumberger Technology Corporation, Houston, TX (US)

( * ) Notice: Subject to any disclaimer, the term of this patent is extended or adjusted under 35 U.S.C. 154(b) by 108 days.

(21) Appl. No.: 13/691,062

(22) Filed: Nov. 30, 2012

(65) Prior Publication Data

US 2013/0087391 A1 Apr. 11, 2013

Related U.S. Application Data

(63) Continuation of application No. 12/578,916, filed on Oct. 14, 2009, now abandoned.

(51) Int. Cl.

| | |
|---|---|
| ***E21B 10/43*** | (2006.01) |
| ***E21B 10/42*** | (2006.01) |
| ***E21B 10/00*** | (2006.01) |

(52) U.S. Cl.
CPC ..... *E21B 10/42* (2013.01); *E21B 10/00* (2013.01)

(58) Field of Classification Search
CPC ..... E21B 10/43; E21B 10/55; E21B 10/5673
USPC ..... 175/57, 171, 426, 430, 431; 703/7
See application file for complete search history.

(56) References Cited

U.S. PATENT DOCUMENTS

| | | | | |
|---|---|---|---|---|
| 4,815,342 | A | 3/1989 | Brett et al. | |
| 5,244,039 | A * | 9/1993 | Newton et al. | 175/431 |
| 6,332,503 | B1 * | 12/2001 | Pessier et al. | 175/336 |
| 6,672,406 | B2 | 1/2004 | Beuershausen | |
| 7,694,756 | B2 * | 4/2010 | Hall et al. | 175/404 |
| 7,753,144 | B2 * | 7/2010 | Hall et al. | 175/385 |
| 8,622,155 | B2 * | 1/2014 | Hall et al. | 175/431 |
| 2006/0032677 | A1 * | 2/2006 | Azar et al. | 175/430 |
| 2008/0035380 | A1 * | 2/2008 | Hall et al. | 175/327 |
| 2008/0035388 | A1 * | 2/2008 | Hall et al. | 175/429 |
| 2010/0155151 | A1 * | 6/2010 | Drews et al. | 175/431 |

* cited by examiner

*Primary Examiner* — Shane Bomar
*Assistant Examiner* — Kipp Wallace
(74) *Attorney, Agent, or Firm* — Osha Liang LLP

(57) ABSTRACT

A drill bit has a bit body with a plurality of fixed blades and a plurality of cutters disposed on the plurality of blades. The plurality of cutters includes a plurality of flat shear type cutters and at least one conical shaped cutter, wherein the plurality of flat shear type cutters define a cutter profile.

21 Claims, 16 Drawing Sheets

FIXED BLADED DRILL BIT CUTTER PROFILE

CROSS REFERENCE TO RELATED APPLICATIONS

This patent application is a continuation of U.S. patent application Ser. No. 12/578,916, which is herein incorporated by reference in its entirety.

BACKGROUND OF THE INVENTION

Rotary drag bits are a type of fixed bladed drill bit that are typically used to shear rock with a continuous scraping motion. A typical fixed bladed bit will comprise a bit body, several blades protruding from the bit body, and a plurality of cutters fixed on the exposed edge of each of the blades. These cutters may be formed from any hard and abrasive material but are generally composed of polycrystalline diamond compact (PDC). A fixed bladed bit may be rotated in an earthen formation allowing the cutters to engage the rock and debris to be removed via the vacant spaces between the blades.

Fixed bladed bits may be designed to optimize cutter efficiency. Methods of designing fixed bladed bits for optimal cutter efficiency may include performing a force balance. A force balance comprises summing the forces on each cutter and calculating the imbalance of forces in relation to the bit. Once a force balance has been performed, modifications may be made to the locations and orientations of the cutters to adjust the forces acting on the bit. This process may be performed several times during the design of a fixed bladed bit.

One such method for designing a rotary drag bit for optimal cutter efficiency is disclosed in U.S. Pat. No. 4,815,342 to Brett, which is herein incorporated by reference for all that it contains. Brett discloses a method for modeling and building drill bits where an array of spatial coordinates representative of selected surface points on a drill bit body and on cutters mounted thereon is created. The array is used to calculate the position of each cutting surface relative to the longitudinal axis of the bit body. A vertical reference plane which contains the longitudinal axis of the bit body is established. Coordinates defining each cutter surface are rotated about the longitudinal axis of the bit body and projected onto the reference plane thereby defining a projected cutting surface profile. In manufacturing a drill bit, a preselected number of cutters are mounted on the bit body. A model of the geometry of the bit body is generated as above described. Thereafter, the imbalance force which would occur in the bit body under defined drilling parameters is calculated, The imbalance force and model are used to calculate the position of an additional cutter or cutters which when mounted on the bit in the calculated position would reduce the imbalance force. A cutter or cutters is then mounted in the position or positions so calculated.

Another such method for designing a rotary drag bit for optimal cutter efficiency is disclosed in U.S. Pat. No. 6,672,406 to Beuershausen, which is herein incorporated by reference for all that it contains. Beuershausen discloses methods including providing and using rotary drill bits incorporating cutting elements having appropriately aggressive and appropriately positioned cutting surfaces so as to enable the cutting elements to engage the particular formation being drilled at an appropriate depth-of-cut at a given weight-on-bit to maximize rate of penetration without generating excessive, unwanted torque on bit. The configuration, surface area, and effective back rake angle of each provided cutting surface, as well as individual cutter back rake angles, may be customized and varied to provide a cutting element having a cutting face aggressiveness profile that varies both longitudinally and radially along the cutting face of the cutting element.

BRIEF SUMMARY OF THE INVENTION

One embodiment of the present invention comprises a force balanced drill bit. Such a drill bit may comprise a bit body comprising a plurality of fixed blades, each blade comprising cutters defining a cutter profile. Junk slots may be disposed between the blades and define the blade boundaries. The blade boundaries may be spaced apart sufficiently to achieve force balance.

Nozzles may be disposed on the bit body such that they aim into the junk slots. Each nozzle may aim into a given junk slot. The blade boundaries may be spaced sufficiently apart to receive a plurality of nozzles.

The cutter profile may be defined by the number of cutters, spacing of the cutters, type of cutters, back rake, and side rake. The cutters may be flat shear type cutters, conical shaped cutters, or a combination of various types of cutters. The cutters may be comprised of polycrystalline diamond or other super hard materials known in the art. Since the force balance is achieved by the spacing of the blade boundaries, the cutters may be evenly spaced along the cutter profile.

The blade boundaries may not be evenly spaced. In fact, the cutter profile may be such that if the blade boundaries were evenly spaced then the drill bit would no longer be force balanced. The drill bit may comprise a center axis and each of the plurality of blades disposed around the center axis may be spaced such that the blades are within six degrees of an even spacing around the center axis.

Each blade may comprise a blade profile defined by a starting position, curvature radii and/or angular length, a bit depth and a bit diameter. Each blade may comprise a similar blade profile or varying blade profiles.

A jack element may be disposed intermediate the plurality of fixed blades. The jack element may be disposed on the center axis. The jack element may be used in a jack steering system or jack hammering system.

Another embodiment of the present invention comprises a method of optimizing fixed bladed bit efficiency during the design stage by adjusting the locations and orientations of blades, rather than cutters, on the bit. Such a method may comprise the steps of modeling a fixed bladed bit by inputting blade and cutter parameters into a computer program, performing a force balance on the modeled fixed bladed bit, and modifying at least one blade parameter to adjust the force balance. The parameters for modeling a fixed bladed bit may include cutter placement on a plurality of blades integrally formed in a bit body and a position for each blade.

The step of modeling a fixed bladed bit using a computer program may include creating a blade profile, a cutter profile, and a blade layout. The blade profile may be defined by first selecting a blade profile type from a definite number of blade profile types which may include profiles containing: three distinct curvatures, at least one linear edge in between a plurality of curvatures, or at least one curvature in between a plurality of linear edges. The blade profile may then be defined by a starting position, curvature radii, curvature angular length, bit depth and bit diameter. The cutter profile may be defined by the number of cutters, spacing of the cutters, type of cutters, back rake, and side rake. The blade layout may be defined by the number of blades, blade thickness, and blade offset.

After the blade and cutter parameters have been inputted, selected parameters may be allowed to be manually manipulated. These parameters may include the side rake, back rake, profile offset, normal offset, cutter diameter, cutter length, blade rotation, and starting cutter placement.

After the fixed bladed bit has been modeled, a force balance on the fixed bladed bit may be performed. This force balance may comprise summing the forces on each cutter and calculating the imbalance of forces in relation to the bit. The force balance may be dependent upon an inputted depth of cut value. Upon performing the force balance, the computer program may visually display force vectors representing the forces acting on each cutter. Reduction of the imbalance of forces resulting from the force balance may be achieved by adjusting the position of at least one blade. The at least one blade may have an angular displacement within six degrees of its original position. The cutter parameters and the blade profile may remain the same while the blade parameters of the fixed bladed bit are modified.

The steps of performing a force balance and modifying at least one blade parameter may also be performed on a modeled fixed bladed bit inputted from an external source. Performing a force balance may also comprise accounting for forces generated by a jack steering system. After modeling or inputting a fixed bladed bit, performing a force balance, and repositioning at least one blade on the fixed bladed bit, the fixed bladed bit may be outputted to a computer aided design computer program.

DETAILED DESCRIPTION OF THE INVENTION AND THE PREFERRED EMBODIMENT

Figure 1:
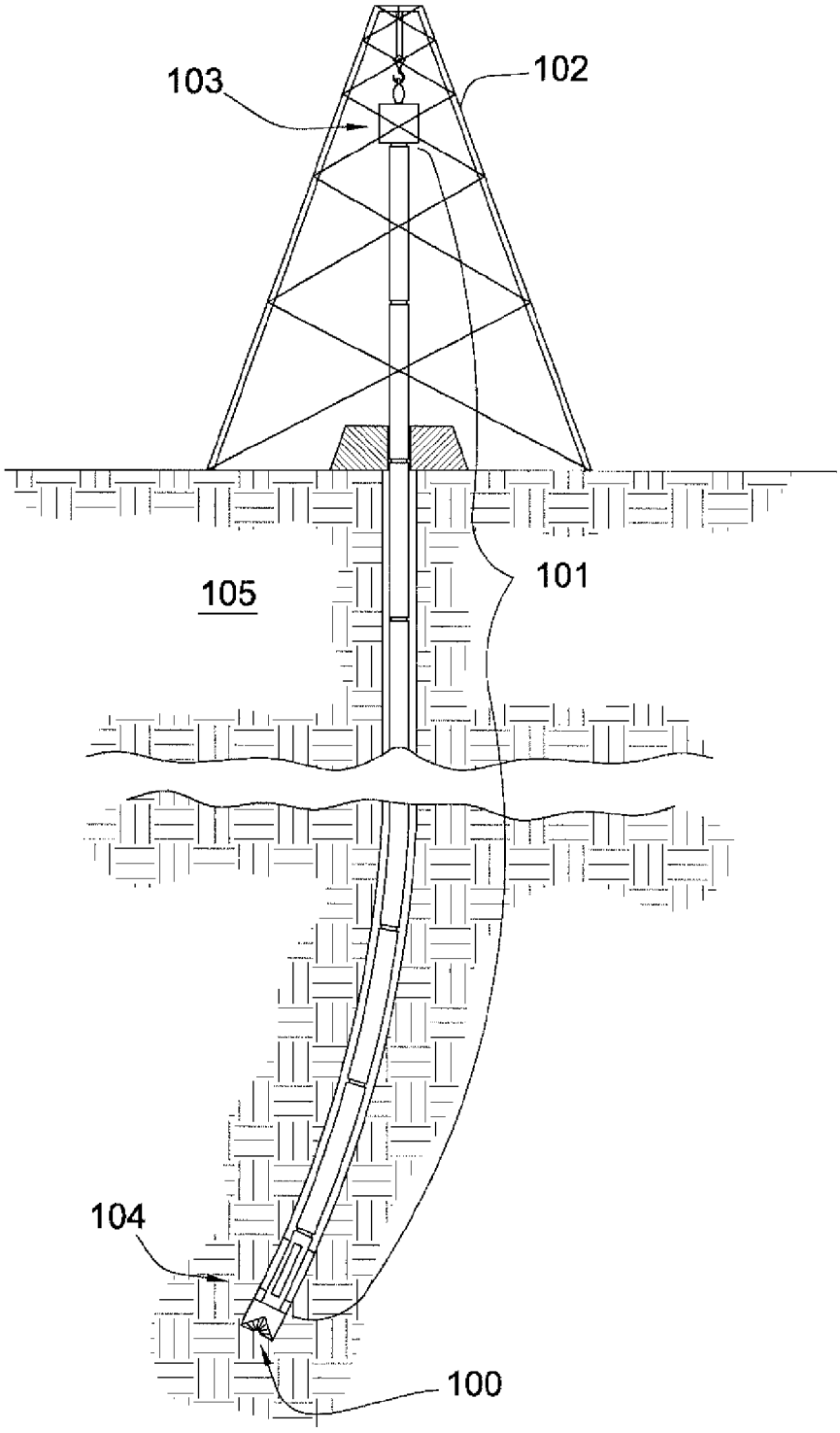
FIG. 1 is a cross-sectional side view of an embodiment of a drill string.

Moving now to the figures, FIG. 1 displays a cross-sectional side view of an embodiment of a downhole drill string 101. The downhole drill string 101 may be suspended by a derrick 102 within an earthen formation 105. The drill string 101 may comprise one or more downhole components 104 including a fixed bladed bit 100 linked together and in communication with an uphole assembly 103. The drill string 101 may be rotated at the derrick 102 causing the fixed bladed bit 100 to engage the earthen formation 105. The fixed bladed bit 100 may comprise a rotary drag bit that may shear rock within the earthen formation 105 with a generally continuous scraping motion. The fixed bladed bit 100 may also comprise non-drag bits that may fail the rock by other methods.

Figure 2:
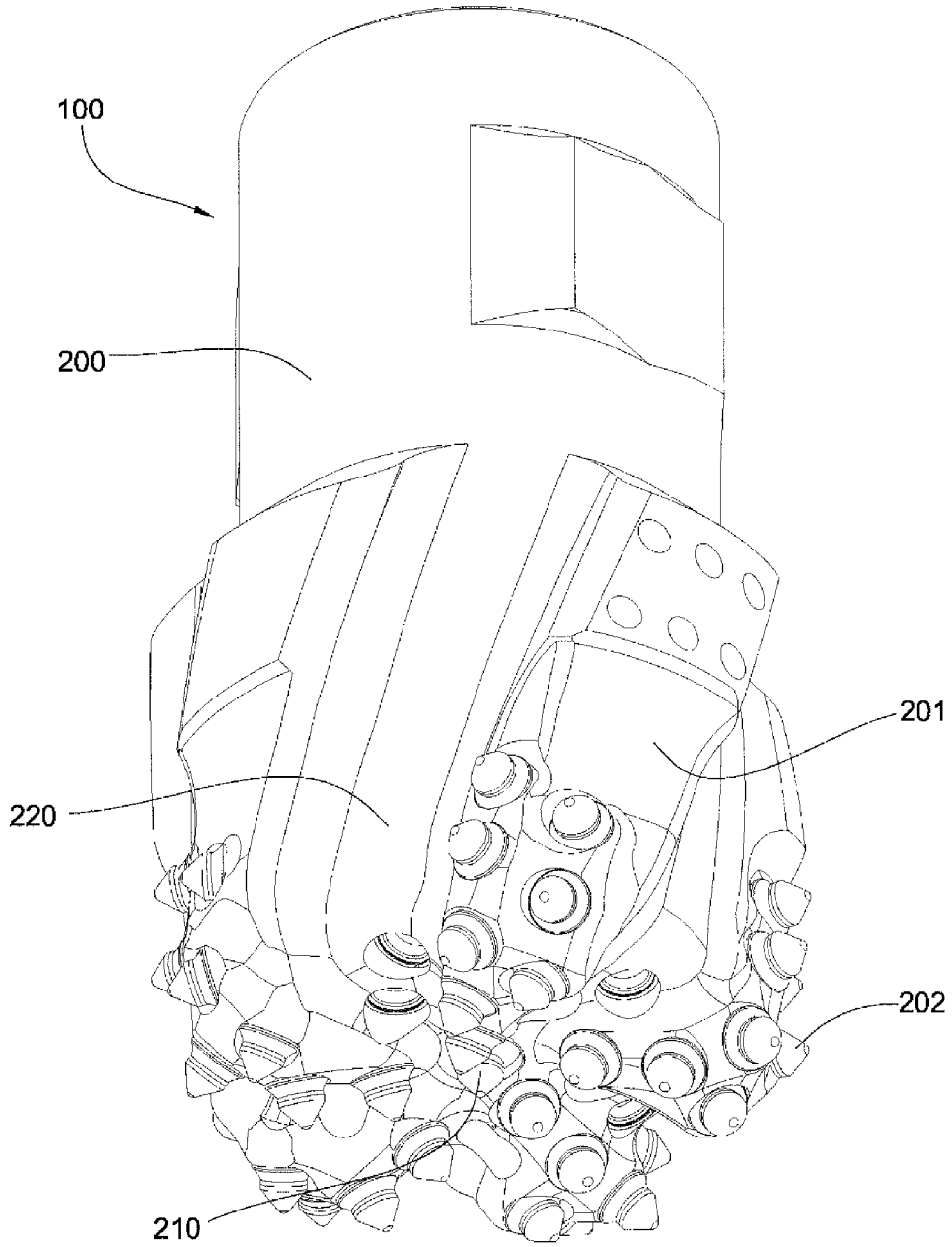
FIG. 2 is a perspective view of an embodiment of a fixed bladed bit.

FIG. 2 shows a perspective view of an embodiment of a fixed bladed bit 100. The fixed bladed bit 100 comprises a bit body 200, several blades 201 protruding from the bit body 200, and a plurality of cutters 202 fixed on an exposed edge of each of the blades 201. These cutters 202 may be formed from any hard and abrasive material but are generally composed of polycrystalline diamond compact (PDC). The cutters 202 may be flat shear type cutters, conical-shaped cutters, or other cutter geometries known in the art. Suitable conical-shaped cutters are manufactured under the brand name Stinger® by Novatek Inc., 2185 S. Larsen Parkway, Provo, Utah 84606. As the fixed bladed bit 100 is rotated in an earthen formation, the cutters 202 may engage rock within the earthen formation and debris may be removed via the vacant spaces, known as junk slots 220, between the blades 201. If the fixed bladed bit 100 comprises flat shear type cutters then the fixed bladed bit 100 may comprise a rotary drag bit and may shear rock with a generally continuous scraping motion. If the fixed bladed bit 100 comprises conical-shaped cutters then the fixed bladed bit 100 may cleave chunks of rock from a formation.

The fixed bladed bit 100 may also comprise a jack element 210. The jack element 210 may form part of a jack steering system where the fixed bladed bit 100 is urged in a desired direction by the jack element 210. The desired direction may change throughout the drilling process. The jack element 210 may also form part of a jack hammering system where the jack element 210 oscillates back and forth to help break up the formation.

Figure 3:
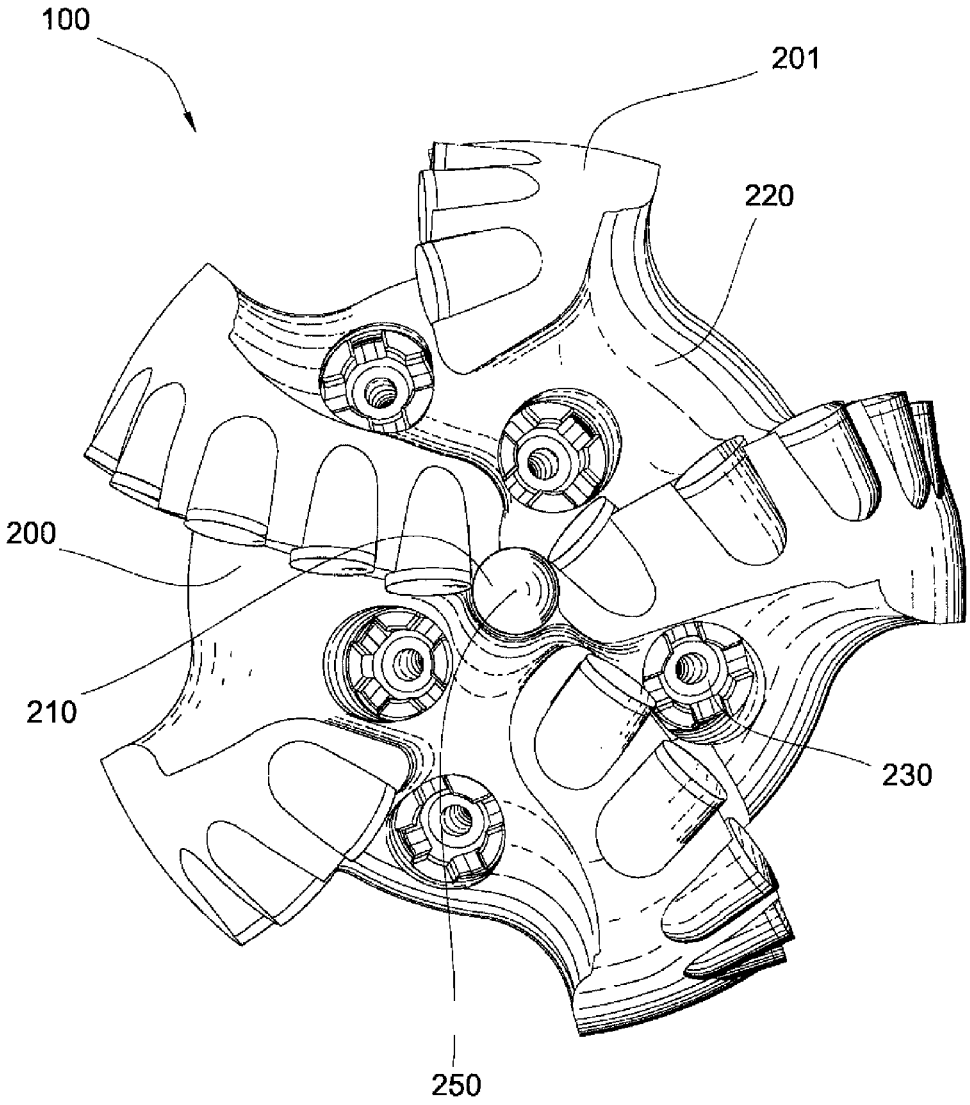
FIG. 3 is a front view of an embodiment of a fixed bladed bit.

FIG. 3 shows a front view of an embodiment of a fixed bladed bit 100. The fixed bladed bit 100 may comprise nozzles 230 disposed on the bit body 200 and aiming into junk slots 220. In the embodiment shown, each individual nozzle 230 aims into an individual junk slot 220. Also in the embodiment shown, the jack element 210 is disposed on a center axis 250.

Figure 4A:
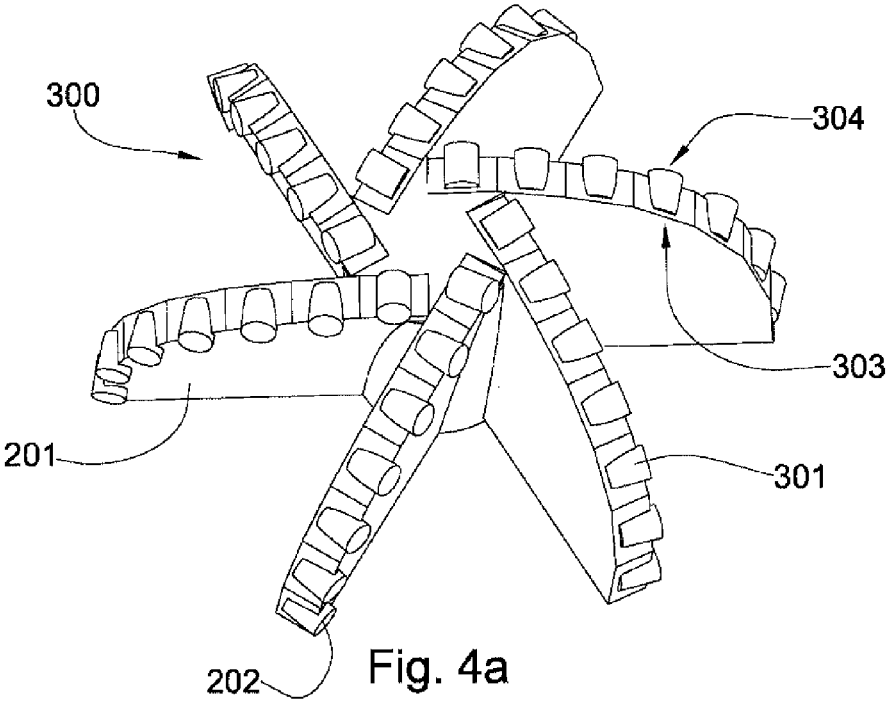
FIG. 4*a* is a perspective view of an embodiment of a modeled fixed bladed bit.
Figure 4B:
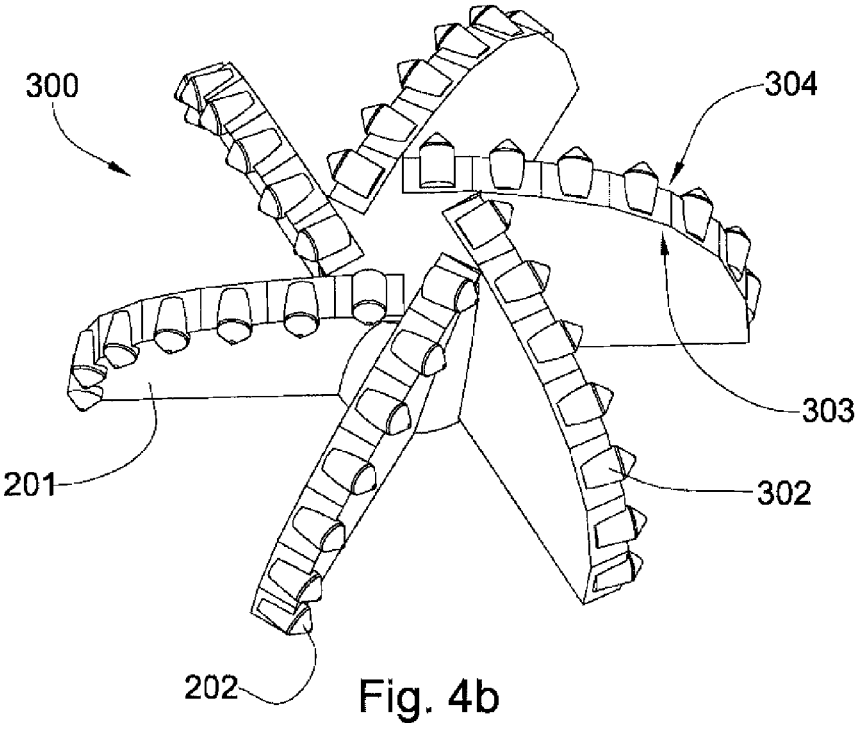
FIG. 4*b* is a perspective view of another embodiment of a modeled fixed bladed bit.

FIGS. 4*a* and 4*b* show perspective views of an embodiment of a modeled fixed bladed bit 300. While designing a fixed bladed bit, a computer program may be used to model the fixed bladed bit digitally. One of the advantages of creating a modeled fixed bladed bit 300 is that calculations may be performed on the modeled fixed bladed bit 300 without the expense of building a physical fixed bladed bit. In order to model a fixed bladed bit, parameters may be inputted into a computer program to form a blade profile 303 and a cutter profile 304. The blade profile 303 is a 2-dimensional outline of an individual blade 201. The cutter profile 304 is a layout of the positioning of a plurality of cutters 202 placed on a blade profile 303. FIG. 4*a* shows a perspective view of an embodiment of a modeled fixed bladed bit 300 with PCD shear cutters 301 and FIG. 4*b* shows a perspective view of an embodiment of a modeled fixed bladed bit 300 with PCD conical-shaped cutters 302.

Figure 5:
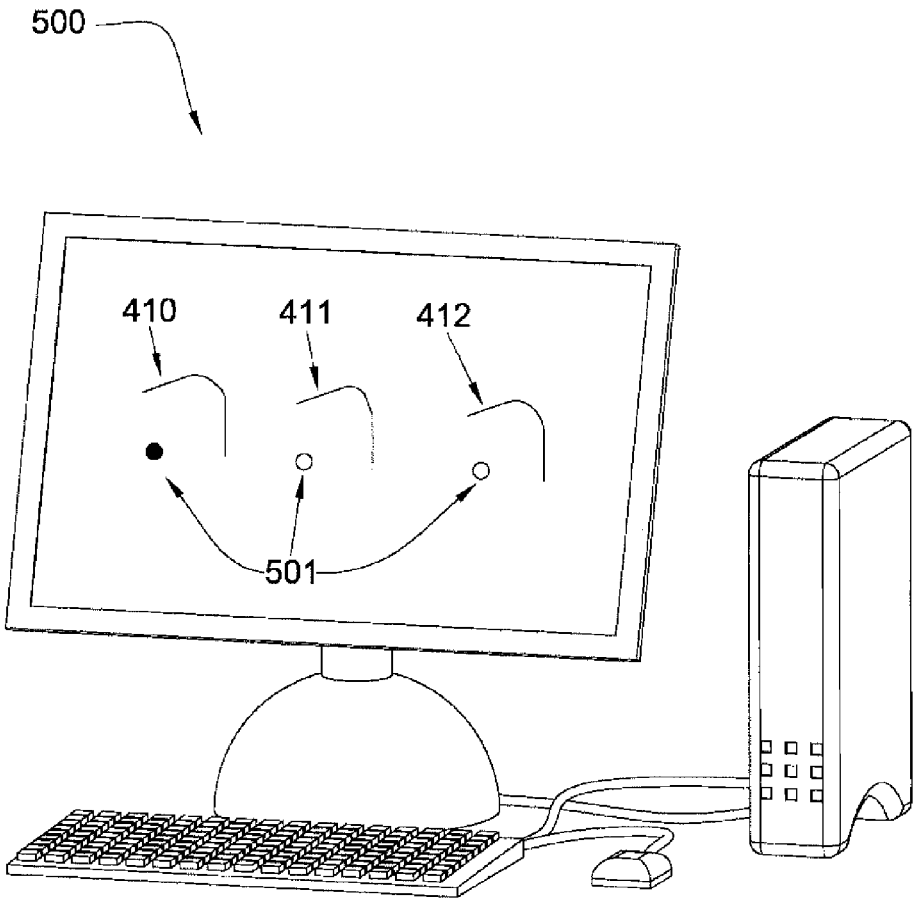
FIG. 5 is a perspective view of an embodiment of a computer display.

FIG. 5 shows a perspective view of an embodiment of a computer display 500. When designing a downhole fixed bladed bit with a computer program, a user may first choose a blade profile type from a definite number of blade profile types as shown on a computer display 500. In the embodiment shown, blade profile 410, blade profile 411, and blade profile 412 are available for the user to chose. Option buttons 501 may be used to select a blade profile type.

Figure 6A:
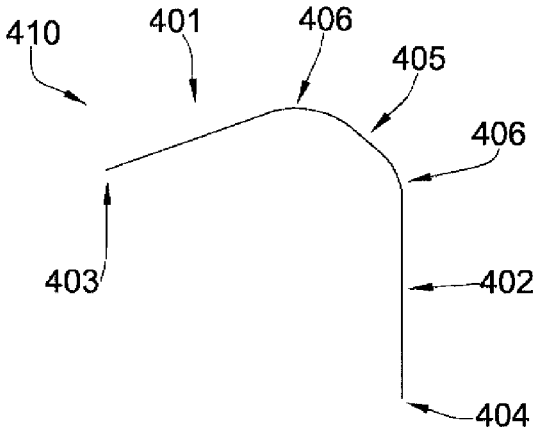
FIG. 6*a* is a 2-dimensional view of an embodiment of a blade profile.
Figure 6B:
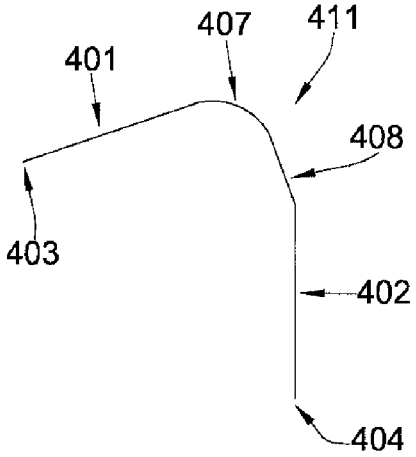
FIG. 6*b* is a 2-dimensional view of another embodiment of a blade profile.
Figure 6C:
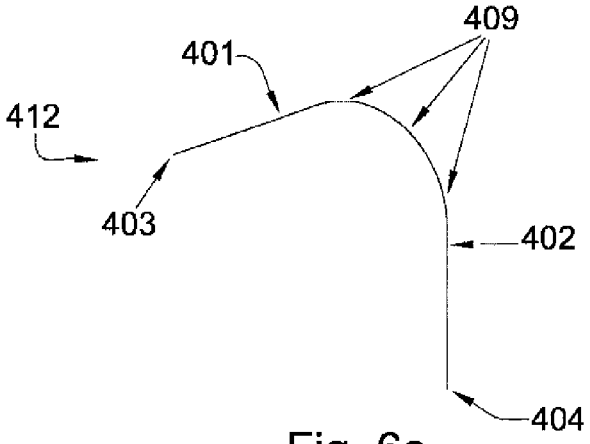
FIG. 6*c* is a 2-dimensional view of another embodiment of a blade profile.

FIGS. 6*a*, 6*b*, and 6*c* are 2-dimensional views of embodiments of blade profiles 410, 411, and 412 respectively. Each blade profile 410, 411, and 412 has a first linear edge 401 and a second linear-edge 402. The first linear edge 401 terminates at a first end point 403 and the second linear edge 402 terminates at a second end point 404. The first linear edge 401 and the second linear edge 402 may be connected by a plurality of combinations of curvatures and linear edges as shown in the following embodiments. FIG. 6*a* shows a 2-dimensional view of an embodiment of a blade profile 410 comprising at least one linear edge 405 between a plurality of curvatures 406. FIG. 6*b* shows a 2-dimensional view of an embodiment of a blade profile 411 comprising at least one curvature 407 adjacent a linear edge 408. FIG. 6*c* shows a 2-dimensional view of an embodiment of a blade profile 412 comprising three distinct curvatures 409.

Figure 7:
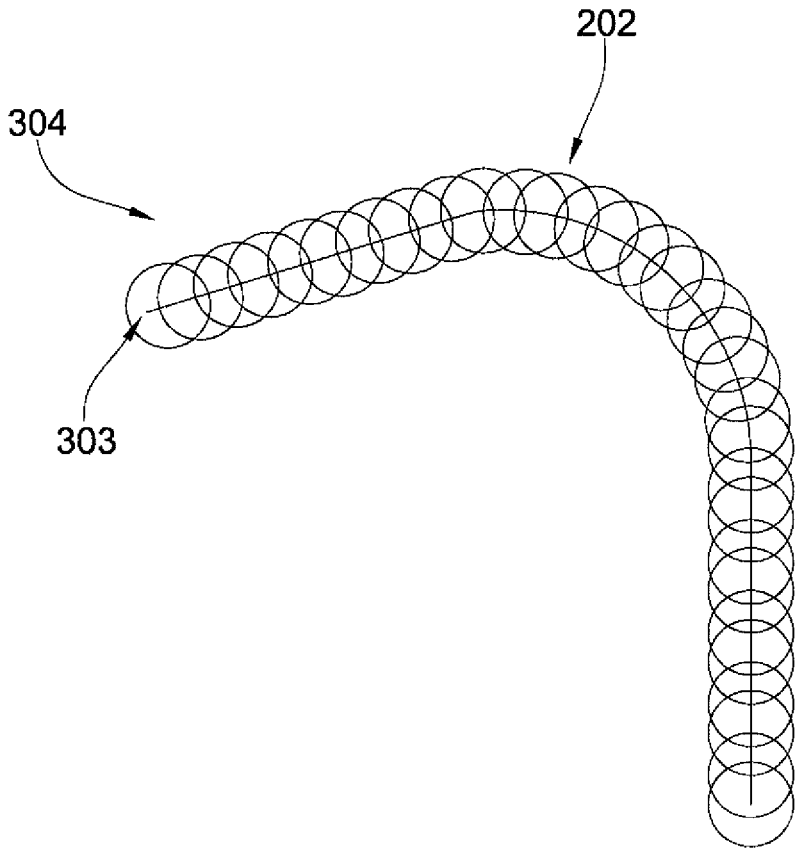
FIG. 7 is a 2-dimensional view of an embodiment of a cutter profile.

FIG. 7 shows a 2-dimensional view of an embodiment of a cutter profile 304. The cutter profile 304 may be formed from a blade profile 303 with the addition of a plurality of cutters 202. The cutters 202 may be placed on the blade profile 303 according to cutter profile 304 parameters that may include: number of cutters 202, spacing of cutters 202, type of cutters 202, back rake, and side rake, In the embodiment shown, the cutters 202 are equally spaced throughout the cutter profile 304. In other embodiments, the cutters 202 may be uniquely spaced throughout the cutter profile 304 and in accordance to other inputs.

Figure 8:
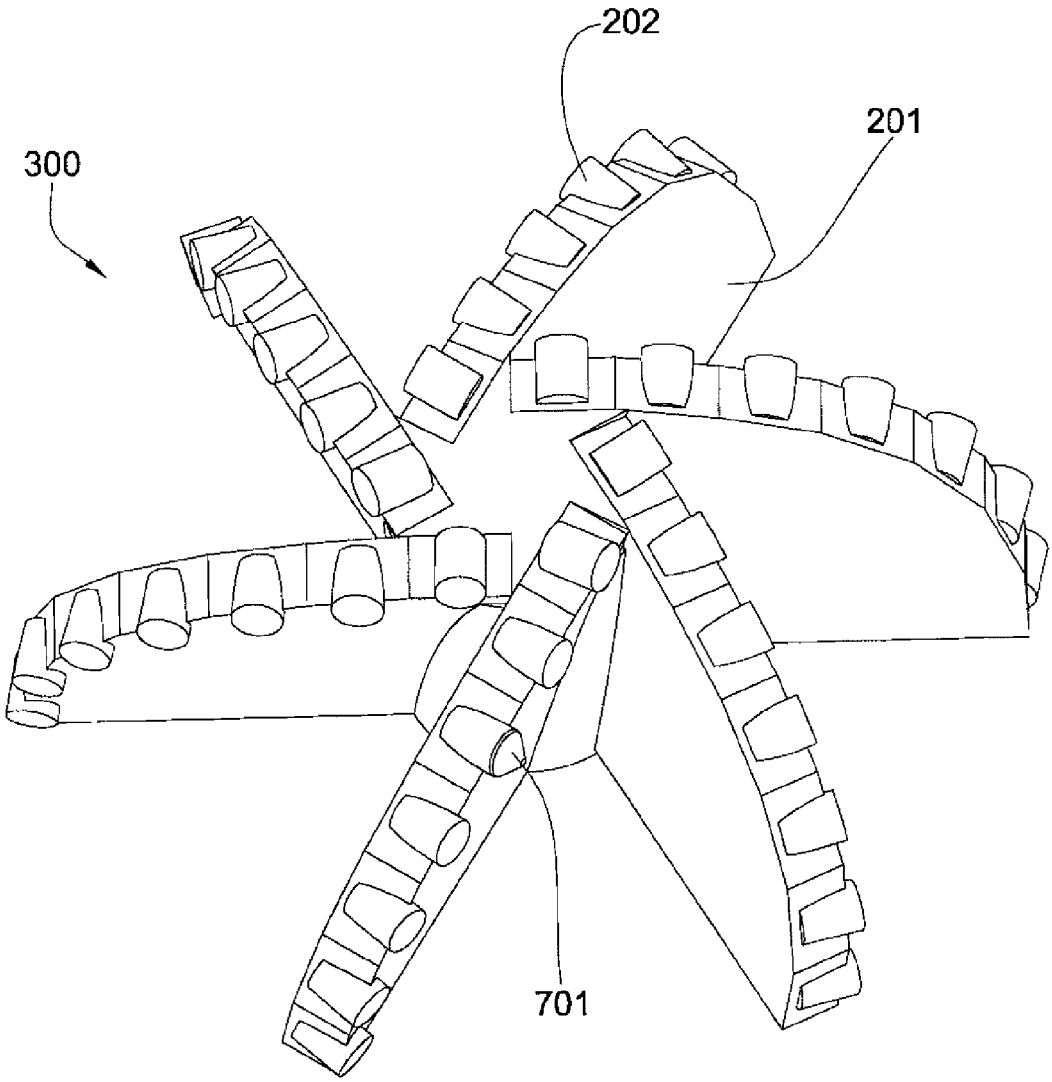
FIG. 8 is a perspective view of another embodiment of a modeled fixed bladed bit.

FIG. 8 is a perspective view of another embodiment of a modeled fixed bladed bit 300. A user may manually manipulate the parameters of the modeled fixed bladed bit 300. The user may manually manipulate individual cutters 202 or individual blades 201. In the embodiment shown, a cutter 701 has been modified. Each cutter 202 on the fixed bladed bit 300 is a PCD shear cutter with the exception of cutter 701 which is a PCD conical-shaped cutter. The user may manually manipulate the parameters consisting of: type of cutter 202, side rake, back rake, profile offset, normal offset, cutter 202 diameter, cutter 202 length, blade rotation, and cutter 202 placement starting diameter. The cutter 202 placement starting diameter indicates that a first cutter on its corresponding blade will be located at a set length away from the center of the fixed bladed bit.

Figure 9:
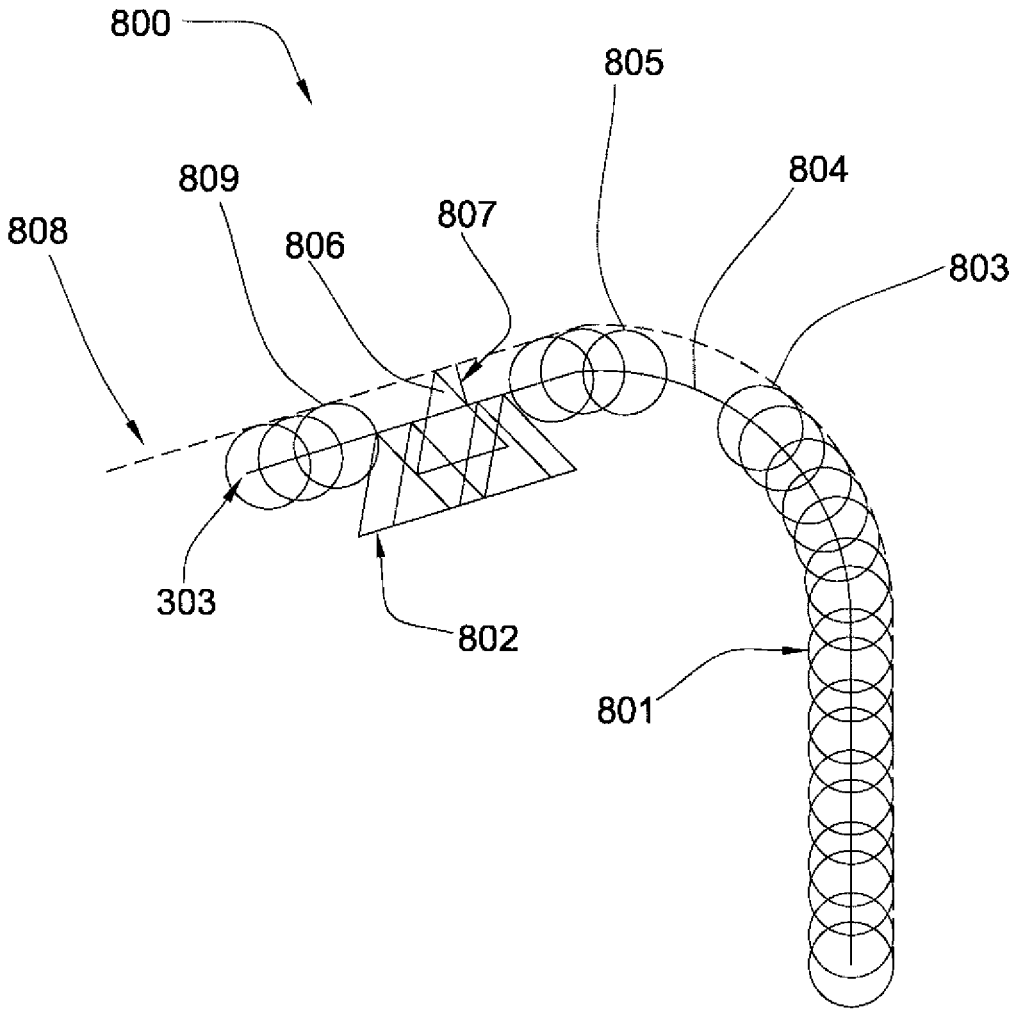
FIG. 9 is a 2-dimensional view of an embodiment of another cutter profile.

FIG. 9 shows a 2-dimensional view of another cutter profile 800. This embodiment of a cutter profile 800 shows how parameters can be manually manipulated with respect to the profile offset and the normal offset. The cutter profile 800 is formed from a blade profile 303 with the addition of a plurality of shear cutters 801 and a plurality of conical shaped cutters 802. The profile offset is a distance which offsets a cutter position along the cutter profile 800. As seen in the figure. a shear cutter 803 has been offset along the cutter profile a distance 804. Therefore the profile offset is the distance 804 in between the shear cutter 803 and the shear cutter 805. The normal offset can be seen with the conical-shaped cutter 806. The normal offset is a distance which offsets a cutter position along a vector normal to the cutter so as to raise or lower a cutter. The conical-shaped cutter 806 must be raised a distance 807 along a vector normal to the cutter so that the conical-shaped cutter 806 can be on the same cutting level 808 as the shear cutter 809. The normal offset is typically used to bring conical-shaped cutters to the same cutting level as shear cutters; however the normal offset can also be used for any other application which requires at least one cutter 801 to be offset along a vector normal to the cutter 801.

Figure 10:
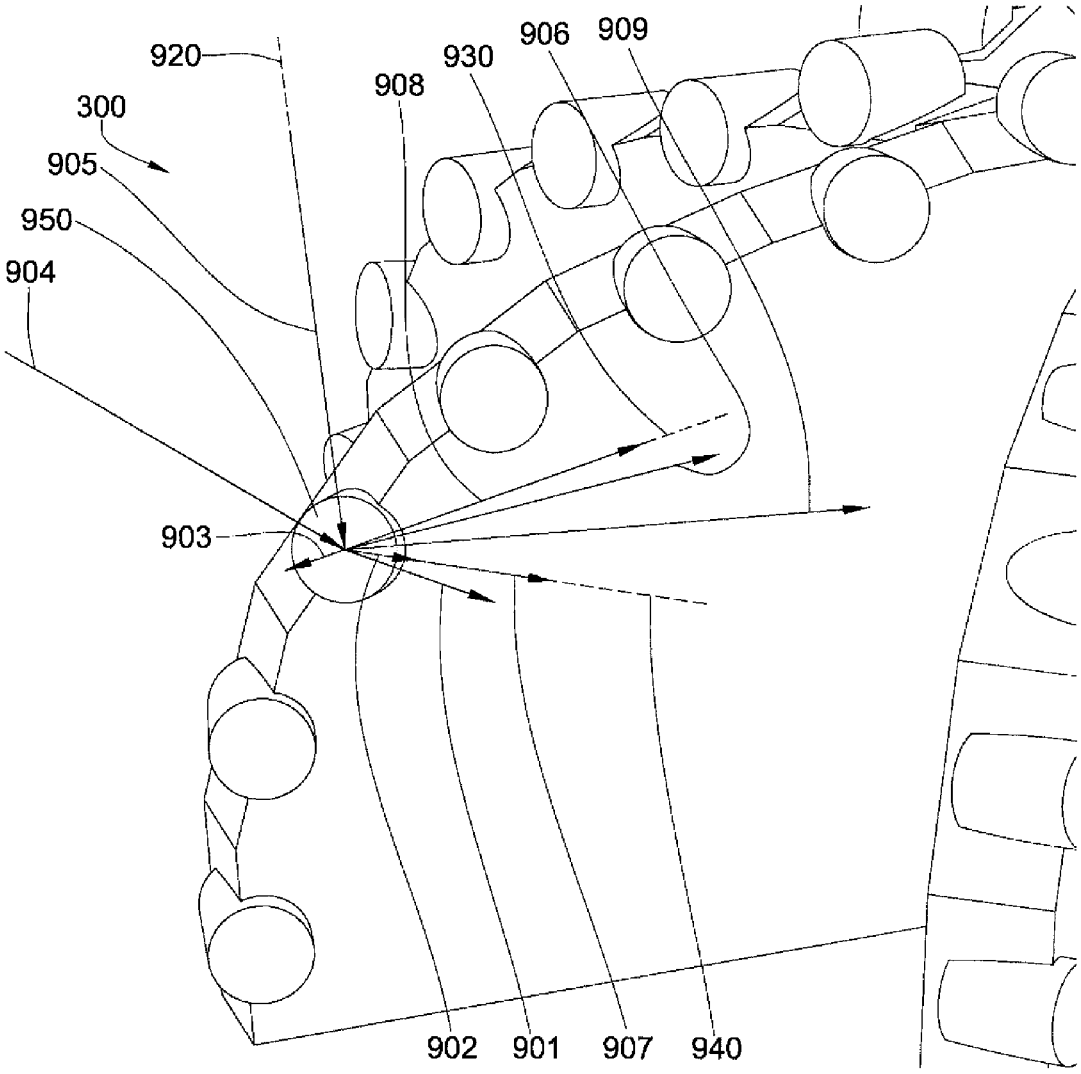
FIG. 10 is a perspective view of another embodiment of a modeled fixed bladed bit.

FIG. 10 is a perspective view of an embodiment of a modeled fixed bladed bit 300. After a fixed bladed bit has been modeled, a force balance may be performed. A force balance is a method of determining the forces acting upon a drill bit while engaged. These forces may be caused by weight-on-bit, torque, a steering system such as a jack steering system, or other causes known in the art. In order to perform a force balance, a depth-of-cut value may be required to determine a weight-on-bit. The purpose of a force balance is to eliminate unbalanced forces acting on a drill bit. Unevenly balanced forces acting on a drill bit may cause cutters to wear more quickly and also make the drill bit less effective. When a force balance is performed, a weight-on-bit imbalance percentage may be calculated. The weight-on-bit imbalance percentage is the numerical value corresponding to the unbalanced forces acting on the bit.

A Cartesian coordinate system comprising a z-axis 920, y-axis 930 and x-axis 940 is shown as a reference for the forces acting on the cutter 950. To perform a force balance, a tangential force 901 may be calculated. The tangential force 901 may be then separated into Cartesian vector components to obtain an x-component of the tangential force 902 and a y-component of the tangential force 903. A normal force 904 may also be calculated. The normal force 904 can be split up into an axial force 905 and a radial force 906. The axial force 905 is the force acting down upon the cutter along the z-axis 920, note also that the axial force 905 is the weight-on-bit that can be controlled during actual drilling. The radial force 906 is the force acting towards the center axis of the modeled fixed bladed bit 300. The radial force 906 may then be separated into Cartesian vector components to obtain an x-component of the radial force 907 and a y-component of the radial force 908. The x-component of the tangential force 902 and the x-component of the radial force 907 may be summed together ($\Sigma x$) and the y-component of the tangential force 903 and the y-component of the radial force 908 may be summed together ($\Sigma y$). A resultant force ($F_{res}$) 909 may then be calculated from $\Sigma x$ and $\Sigma y$ by the equation:

$$(F_{res})^2=(\Sigma x)^2+(\Sigma_Y)^2$$

The weight-on-bit imbalance percentage (WOB %) may then be calculated from the resultant force and the axial force ($F_{ax}$) 905. from the following equation:

$$\text{WOB }\%=(F_{res}/F_{ax})*100$$

If the drill bit was completely balanced, the WOB % would be zero. The WOB % is zero when the forces around the drill bit cancel each other out.

Figure 11:
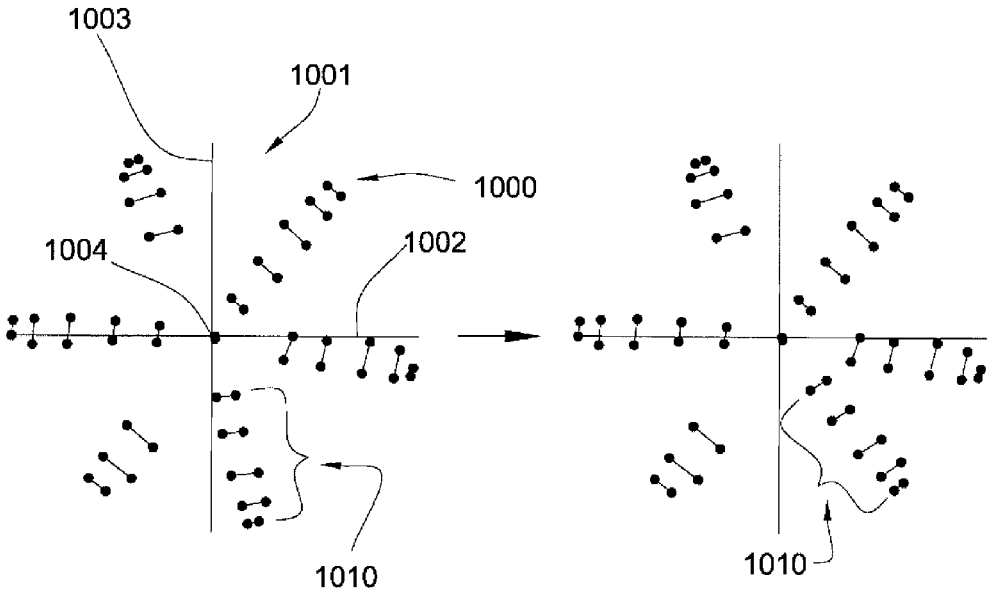
FIG. 11 is a 2-dimensional view of an embodiment of force vectors displayed upon performing a force balance.

FIG. 11 shows a 2-dimensional view of an embodiment of force vectors 1000 that may be displayed when a force balance is performed. Each force vector 1000 represents the magnitude of forces acting on an individual cutter. The magnitude of the forces acting on an individual cutter is dependent upon an area of each individual cutter when engaged. The force vectors 1000 may be shown on a standard Cartesian coordinate system 1001 with an x-axis 1002 and a y-axis 1003. The intersection 1004 of the x-axis 1002 and the y-axis 1003 is the point that corresponds to the center of the modeled fixed bladed bit. By using the standard Cartesian coordinate system 1001, users can identify where the forces are unbalanced and make adjustments in order to balance the forces and minimize the WOB %. As shown in the figure, each force vector 1000 represents the forces acting on each cutter. When adjustments are needed in order to balance the forces and minimize the WOB %, at least one blade is rotated around the center axis. As the at least one blade rotates, the forces acting on each cutter at the new position can be represented by a new force balance. Therefore the force vectors 1010 originate in a first position, then upon rotating the blade, the force vectors 1010 end in a second position.

Figure 12:
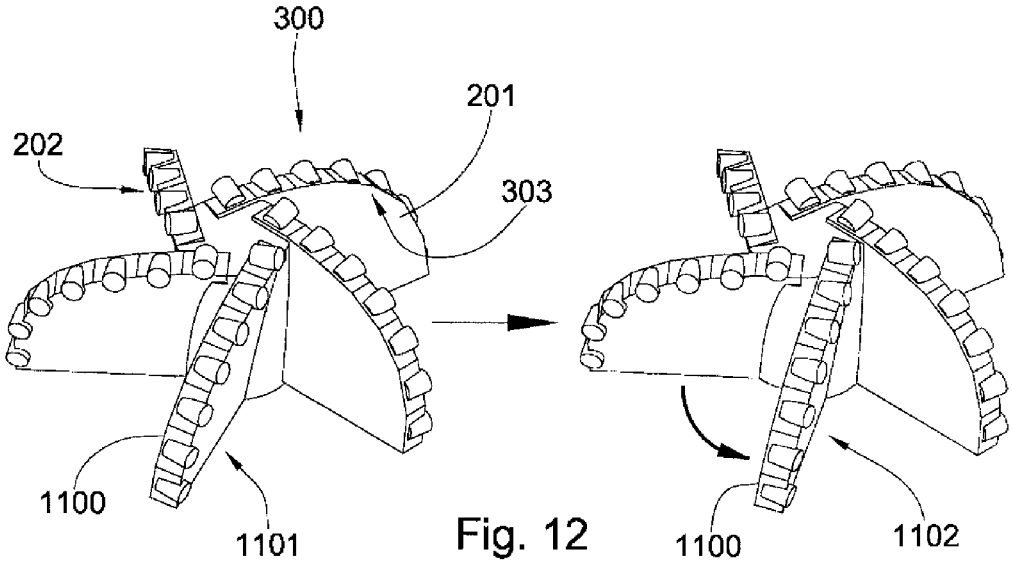
FIG. 12 is a perspective view of another embodiment of a modeled fixed bladed bit.

FIG. 12 shows a perspective view of another embodiment of a modeled fixed bladed bit 300. At least one blade 201 may be rotated in order to adjust the force balance. In the embodiment shown, a blade 1100 is in an original position 1101. After a force balance is performed, the blade 1100 may be rotated about a center of the drill bit to a new position 1102. By rotating the blade 1100, the force vectors may be adjusted and the force balance may become substantially balanced In the embodiment shown, the blade 1100 rotates about the center of the fixed bladed bit 300 within six degrees with respect to the blade's 1100 original position 1101. It is believed that by rotating at least one blade 201 while the cutters 202 and the blade profile 303 remain unchanged the pattern of cutting may remain the same.

Figure 13:
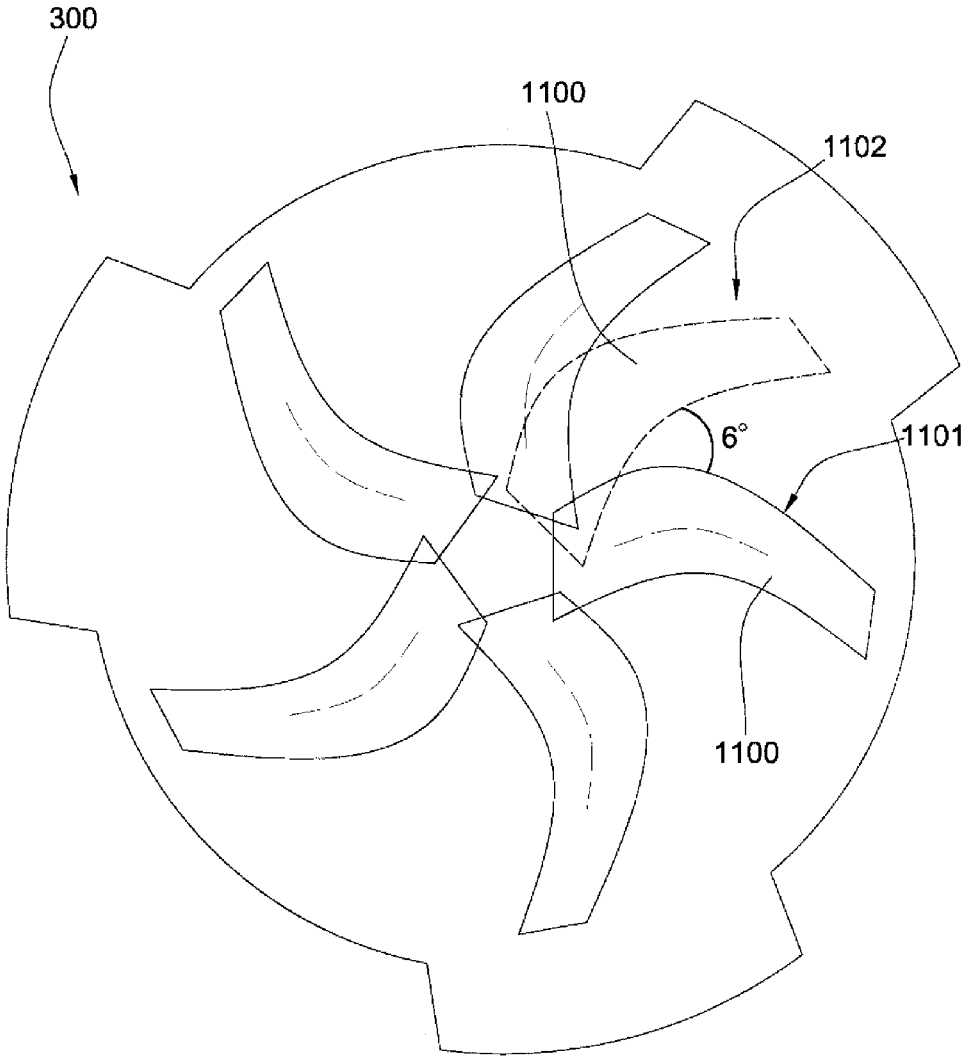
FIG. 13 is a top view of another embodiment of a modeled fixed bladed bit.

FIG. 13 is a top view of another embodiment of a modeled fixed bladed bit 300. In this embodiment, a blade 1100 is in an original position 1101 and then is rotated to a new position 902.

Figure 14:
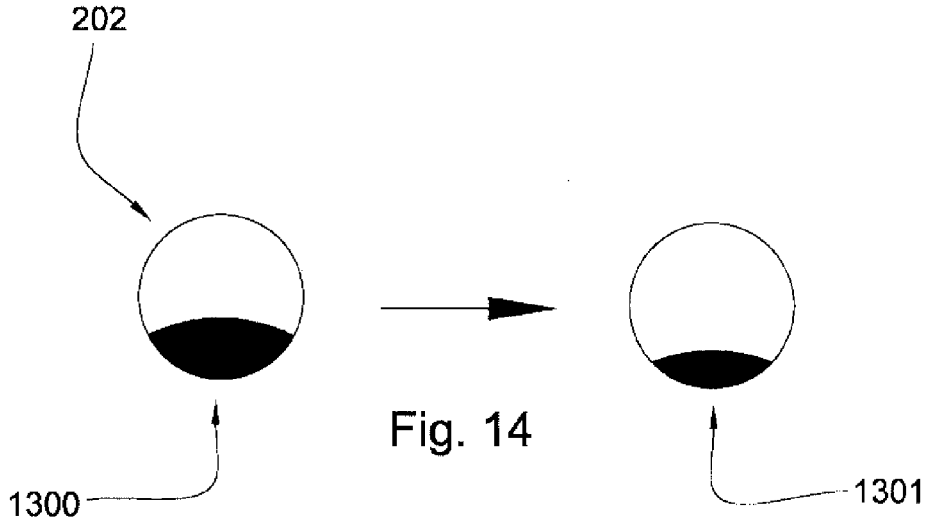
FIG. 14 is a front view of a cutter.

FIG. 14 shows a front view of a cutter 202. The darkened areas 1100 and 1101 represent the surface of the cutter that may engage a formation. In the embodiment shown, area 1300 represents the engaging surface before at least one blade is rotated about the center of the fixed bladed bit and the area 1301 represents the engaging surface after the rotation. The area a cutter engages changes as at least one blade is rotated about the center of the fixed bladed bit because the area a cutter engages is dependent upon the cutters on the other blades. As at least one blade is rotated about the fixed bladed bit, the blade's initial position in relation to the other blades is changed and therefore the area a cutter engages is affected which in turn affects the forces on the cutters and the weight-on-bit imbalance percentage.

Figure 15:
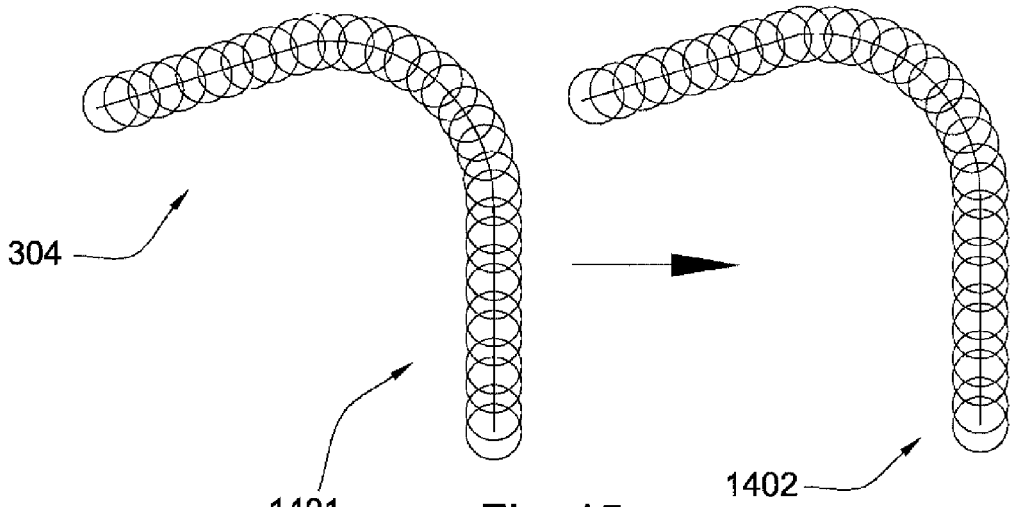
FIG. 15 is a 2-dimensional view of another embodiment of a cutter profile.

FIG. 15 shows a 2-dimensional view of another embodiment of a cutter profile 304. The figure shows the cutter profile 1401 before the rotation of at least one blade about the center of the fixed bladed bit and the cutter profile 1402 after the rotation. As shown, the cutter parameters remain unchanged when modifying at least one blade parameter.

Figure 16:
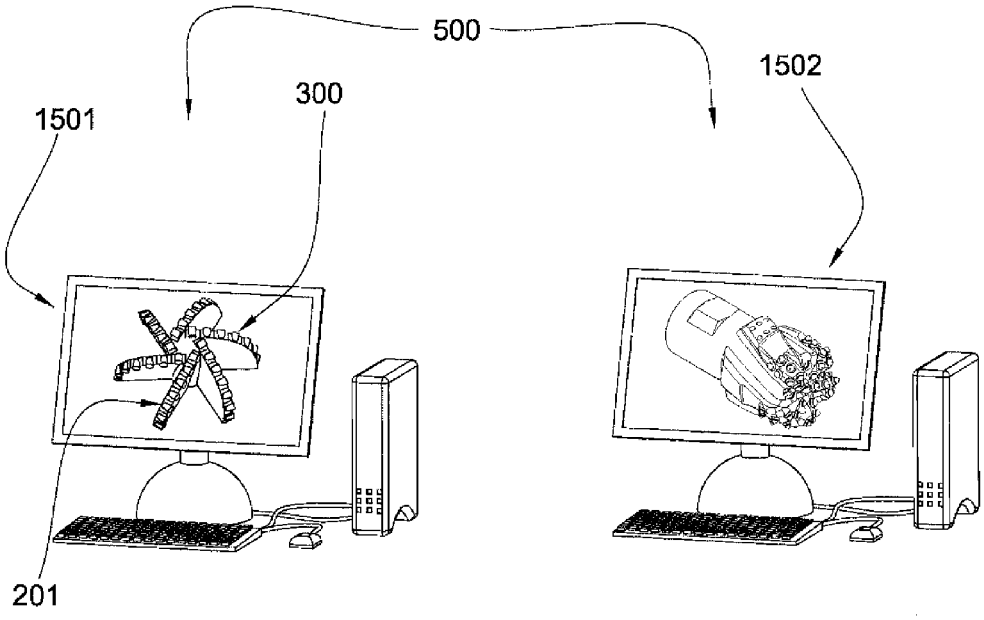
FIG. 16 is a perspective view of an embodiment of a computer display.

FIG. 16 is a perspective view of an embodiment of a computer display 500 showing the output from computer programs 1501 and 1302. Program 1501 comprises the previously described method of modeling a fixed bladed bit 300, performing a force balance on the modeled fixed bladed bit 300, and modifying the modeled fixed bladed bit by rotating at least one blade 201 about the center of the fixed bladed bit 300. Program 1502 is a computer aided design computer program which may import the designed fixed bladed bit 300 from an external source and subsequently perform other functions on it.

Figure 17:
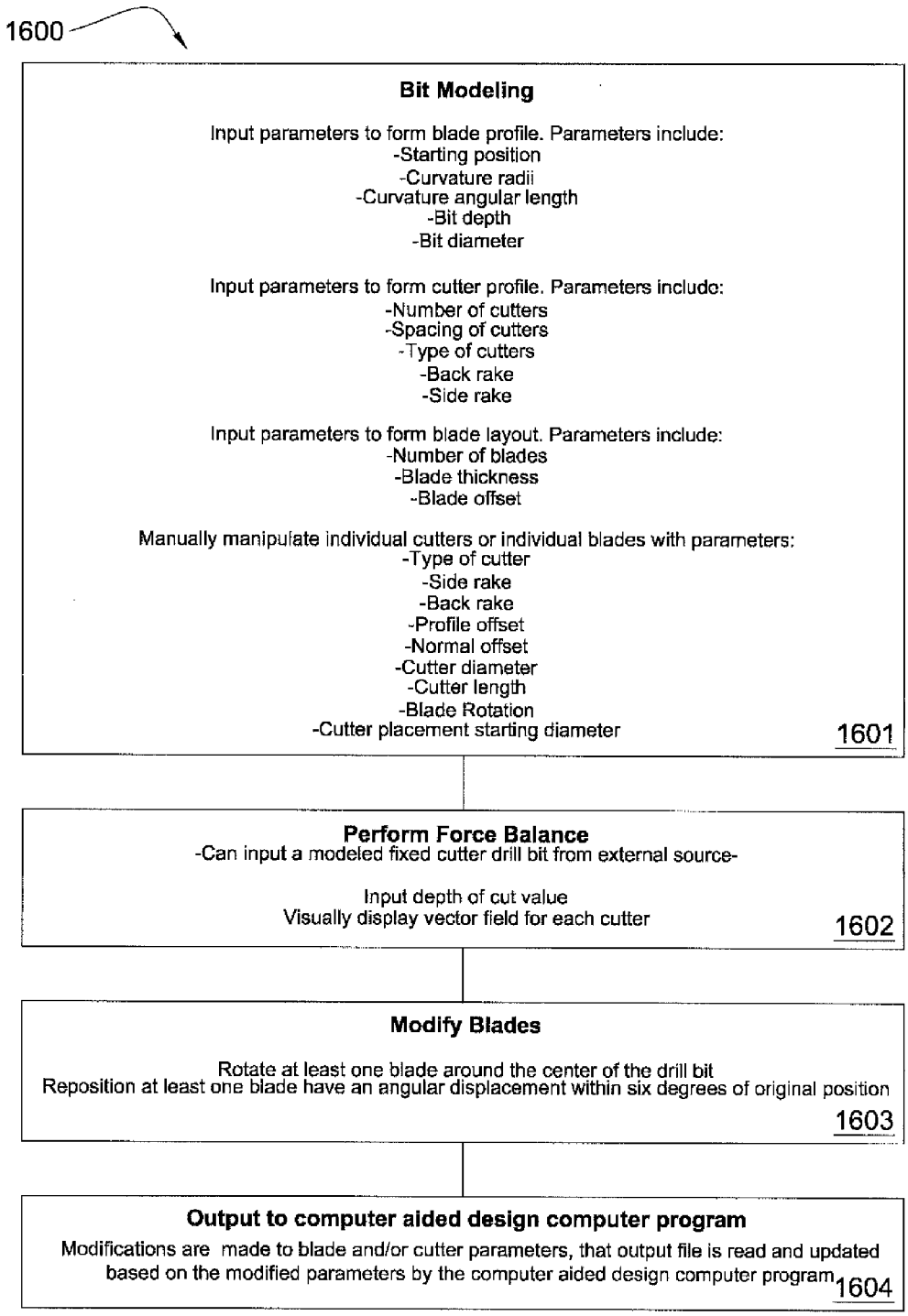
FIG. 17 is a flow chart representing an embodiment of a method of designing a downhole fixed bladed bit.

FIG. 17 shows a flow chart representing an embodiment of a method 1600 of designing a downhole fixed bladed bit comprising the steps of modeling 1601 a fixed bladed bit, performing 1602 a force balance, modifying 1603 blades, and outputting 1604 to a computer aided design computer program. The step of modeling 1601 a fixed bladed bit includes inputting a plurality of blade and cutter parameters that may be used to form a blade profile, a cutter profile, and a blade layout. Parameters that may be used to form the blade profile include: starting position, curvature radii, curvature angular length, bit depth, and bit diameter. Parameters that may be used to form the cutter profile include: number of cutters, spacing of cutters, type of cutters, back rake, and side rake. Parameters that may be used to form the blade layout include: number of blades, blade thickness, and blade offset (measure of spiral for a specific blade). Modeling 1601 a fixed bladed bit may also comprise manually manipulating individual cutters or individual blades using the parameters: side rake, back rake, profile offset, normal offset, cutter diameter, cutter length, blade rotation, and cutter placement starting diameter, The step of performing 1602 a force balance may comprise inputting a depth-of-cut value. When the force balance has been performed, the vector fields for each cutter may be visually displayed. The step of performing 1602 a force balance may be completed on a modeled fixed bladed bit from step 1601 or may be performed on a modeled fixed bladed bit inputted from an external source. The step of modifying 1603 blades comprises rotating at least one blade parameter to adjust the force balance.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

a bit body comprising a plurality of fixed blades;

a plurality of cutters disposed on the plurality of blades, wherein the plurality of cutters comprises a plurality of flat shear type cutters and at least one conical shaped cutter at least one blade having a flat shear type cutter and a conical shaped cutter;

wherein the plurality of flat shear type cutters define a cutter profile at a cutting level formed by a continuous curve extending through the cutting edges of the flat shear type cutters when rotated into a single plane, wherein the conical tip of the at least one conical shaped cutter is closer to a surface to be cut when in use than the cutting level of the flat shear type cutters.

2. The drill bit of claim 1, wherein at least one of the plurality of cutters is offset a distance along the cutter profile.

3. The drill bit of claim 1, wherein the at least one conical shaped cutter is offset a distance along a vector normal to the cutter profile.

4. The drill bit of claim 3, wherein the distance raises the at least one conical shaped cutter to the same cutting level as the plurality of flat shear type cutters defining the cutter profile.

5. The drill bit of claim 1, wherein the at least one conical shaped cutter is positioned along the cutter profile.

6. The drill bit of claim 1, wherein the cutter profile is defined by a number of cutters, spacing of the cutters, type of the cutters, back rake, and side rake.

7. The drill bit of claim 1, wherein the plurality of cutters comprise polycrystalline diamond.

8. The drill bit of claim 1, wherein the plurality of cutters is positioned at the leading side of each blade.

9. The drill bit of claim 1, wherein the flat shear type cutters comprise a substrate with a polycrystalline cutting table thereon having a substantially flat cutting face.

10. The drill bit of claim 1, wherein the at least one conical shaped cutter comprises a substrate with a polycrystalline diamond body having a conical cutting surface thereon.

11. A drill bit, comprising:

a bit body comprising a plurality of fixed blades;

a plurality of cutters disposed on the plurality of blades, wherein the plurality of cutters comprises a plurality of flat shear type cutters and a plurality of conical shaped cutters at least one blade having a flat shear type cutter and a conical shaped cutter;

wherein the plurality of flat shear type cutters define a cutter profile at a cutting level formed by a continuous curve extending through cutting edges of the flat shear type cutters when rotated into a single plane; and wherein the at least one conical shaped cutter is offset so that the conical tip is closer to a surface to be cut when in use than the cutting level of the flat shear type cutters.

12. The drill bit of claim 11, wherein at least one of the plurality of cutters is offset along the cutter profile a distance.

13. The drill bit of claim 11, wherein the at least one conical shaped cutter is offset so that the conical tip is below the cutting level of the flat shear type cutters.

14. The drill bit of claim 11, wherein the at least one conical shaped cutter is offset so that the conical tip is above the cutting level of the flat shear type cutters.

15. A drill bit, comprising:

a bit body comprising a plurality of fixed blades;

a plurality of cutters disposed on the plurality of blades, wherein the plurality of cutters comprises a plurality of shear type cutters comprising a substrate and a diamond table with a substantially flat cutting surface thereon and at least one substantially pointed cutting element comprising a substrate and diamond body thereon terminating in a rounded apex at least one blade having a flat shear type cutter and a conical shaped cutter;

wherein the plurality of flat shear type cutters define a cutter profile at a cutting level formed by a continuous curve extending through cutting edges of the flat shear type cutters when rotated into a single plane, and wherein the rounded apex of the at least one substantially pointed cutting element is closer to a surface to be cut when in use than the cutting level of the cutter profile.

16. The drill bit of claim 15, wherein at least one of the plurality of cutters is offset a distance along the cutter profile.

17. The drill bit of claim 15, wherein the at least one substantially pointed cutting element is offset a distance along a vector normal to the cutter profile.

18. The drill bit of claim 17, wherein the distance raises the at least one substantially pointed cutting element to the same cutting level as the plurality of flat shear type cutters defining the cutter profile.

19. The drill bit of claim 15, wherein the at least one substantially pointed cutting element is positioned along the cutter profile.

20. The drill bit of claim 15, wherein the cutter profile is defined by a number of cutters, spacing of the cutters, type of the cutters, back rake, and side rake.

21. The drill bit of claim 15, wherein the plurality of cutters is positioned at the leading side of each blade.

* * * * *